US007109647B2

(12) United States Patent
Jung

(10) Patent No.: US 7,109,647 B2
(45) Date of Patent: Sep. 19, 2006

(54) LIGHTWEIGHT FLAT SCREEN COLOR CATHODE RAY TUBE

(75) Inventor: Sung-Han Jung, Gyeongsangbuk-do (KR)

(73) Assignee: LG.Philips Display Korea Co., Ltd., Gyeongsangbuk-do (KR)

( * ) Notice: Subject to any disclaimer, the term of this patent is extended or adjusted under 35 U.S.C. 154(b) by 167 days.

(21) Appl. No.: 10/669,260

(22) Filed: Sep. 25, 2003

(65) Prior Publication Data

US 2005/0067940 A1 Mar. 31, 2005

(51) Int. Cl.
*H01J 29/86* (2006.01)
*H01J 31/10* (2006.01)

(52) U.S. Cl. ..... 313/477 R; 313/461; 220/2.1 A; 220/2.1 R

(58) Field of Classification Search ..... 313/477 R, 313/461; 220/2.1 A, 2.3 A, 2.1 R
See application file for complete search history.

(56) References Cited

U.S. PATENT DOCUMENTS 6,885,143 B1 * 4/2005 Kim ..... 313/477 R
2005/0073237 A1 * 4/2005 Baek et al. ..... 313/477 R

FOREIGN PATENT DOCUMENTS

KR 2002076830 A * 10/2002

* cited by examiner

*Primary Examiner*—Karabi Guharay
(74) *Attorney, Agent, or Firm*—McKenna Long & Aldridge LLP

(57) ABSTRACT

A color cathode ray tube includes: a panel whose outer surface is substantially flat and whose inner surface has a predetermined curvature; a funnel coupled with the panel; and a deflection yoke installed on an outer circumference of the funnel, wherein the panel has an aspect ratio of about 4:3 and a diagonal length USD of a viewable image size of the panel is less than about 520 mm. The panel satisfies the following relationship:

$$0.44 \le \frac{OAH}{TOR} \le 0.56$$

where TOR is distance between an end of the deflection yoke adjacent to the panel and a coupling surface between the panel and the funnel, and where OAH is distance between center of the outer surface of the panel and the coupling surface between the panel and the funnel.

18 Claims, 4 Drawing Sheets

LIGHTWEIGHT FLAT SCREEN COLOR CATHODE RAY TUBE

BACKGROUND OF THE INVENTION

1. Field of the Invention

The present invention relates to a flat color panel cathode ray tube (CRT), and more particularly, to a panel structure and a funnel structure of a flat color panel cathode ray tube (CRT).

2. Description of the Related Art

FIG. 1 is a partial side sectional view illustrating a general color cathode ray tube. Referring to FIG. 1, the general color cathode ray tube will be described.

The CRT includes a front panel 1 and a rear funnel 2. The panel 1 and the funnel 2 are all made of glass, and the rear funnel 2 is coupled with a rear side of the front panel 1. A fluorescent material coats the inner surface of the panel 1 to form a fluorescent surface. The fluorescent surface emits light when struck by an electron beam 11. An electron gun 8 generates the electron beam 11 and is located in a neck 10 of the funnel 2. A shadow mask 3 serves to selectively pass the electron beam 11 so that the electron beam 11 reaches a desired position of the fluorescent surface. This shadow mask 3 is supported by a frame 4 and located in the vicinity of the inner surface of the panel 1. The frame 4 is fixed to the panel 1 by a spring 5 and a pin 6. A deflection yoke 9 is installed on an outer circumference of the funnel 2. The deflection yoke 9 sequentially deflects the electron beam 11 up, down, left, and right. The fluorescent surface struck by the electron beam 11 forms a picture. An inner shield 7 is fixed to the frame 7 so that the travel of the electron 11 is not affected by any external earth magnetic field. Because the inside of the CRT is in a high vacuum state, the CRT is vulnerable to external impact. Accordingly, the panel 1 and the funnel 2 are designed to have enough strength to counter such a vacuum pressure. A reinforcing band 12 is installed on the outer surface of the skirt of the panel 1, and thus the stress that the CRT is subject to under a high vacuum is dispersed.

A CRT is an image display device and has been the most popular display device in various fields. Recently, the CRT has been improved due to technology improvements and customers' requests. Especially the flat panel CRT has been developed to minimize image distortion.

Referring to FIG. 2A, the conventional panel includes an inner surface and an outer surface that have a predetermined curvature. Accordingly, an image is distorted and ambient light is reflected in many directions due to the curvature of the outer surface resulting in degraded viewing capability. To improve the conventional panel, as shown in FIG. 2B, a flat panel that has a substantially flat outer surface has been developed. The flat panel removes the image distortion and lowers eye fatigue, so it has gained widespread use recently.

A more detailed description of the difference between the curved panel and the flat panel will be made with reference to FIG. 3. The half cross-sectional surface of the curved panel is depicted on the right side of FIG. 3 and the half cross-sectional surface of the flat panel is depicted on the left side of FIG. 3.

Typically, the curved panel and the flat panel are manufactured on the same manufacturing line. The curved panel is employed in less expensive CRTs and the flat panel is employed in more expensive CRTs. For convenience, the CRT that has the flat panel is called a 'flat panel CRT' and the CRT that has the curved panel is called a 'curved panel CRT'. Accordingly, to enhance the efficiency of the manufacturing processes, as shown in FIG. 3, the flat panel CRT is designed to have the same panel height as the panel height (OAH: the height distance between the center of the outer surface and the seal edge line of a skirt 1 a coupled with the panel 2) of the curved CRT.

However, due to such a design as shown in drawings, the length of the skirt 1*a* of the flat panel gets longer. Because the outer surface of the panel 1 is flat but the inner surface of the panel 1 has a curvature, the corner portion 1*b* gets thicker as compared to the curved panel. Accordingly, the flat panel 1 is heavier than the curved panel 2 by about 10–15%, so that the assembly process for the flat panel CRT becomes more difficult, and its use becomes inconvenient. Also, the flat panel 1 is vulnerable to excess thermal stress in a furnace as the volume and weight increases.

SUMMARY OF THE INVENTION

Accordingly, the present invention is directed to a color cathode ray tube that substantially obviates one or more problems due to limitations and disadvantages of the related art.

An advantage of the present invention is to provide a color cathode ray tube that is light in weight.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the invention, as embodied and broadly described, the color cathode ray tube includes: a panel whose outer surface is substantially flat and whose inner surface has a predetermined curvature; a funnel coupled with the panel; and a deflection yoke installed on an outer circumference of the funnel, wherein the panel has an aspect ratio of about 4:3 and a diagonal length USD of a viewable image size of the panel is less than about 520 mm. The panel satisfies the following relationship:

$$0.44 \leq \frac{\text{OAH}}{\text{TOR}} \leq 0.56$$

where TOR is distance between an end of the deflection yoke adjacent to the panel and a coupling surface between the panel and the funnel, and where OAH is distance between center of the outer surface of the panel and the coupling surface between the panel and the funnel.

In another aspect of the present invention, a The color cathode ray tube includes: a panel whose outer surface is substantially flat and whose inner surface has a predetermined curvature; a funnel coupled with the panel; and a deflection yoke installed on an outer circumference of the funnel, wherein the panel has an aspect ratio of about 4:3 and a diagonal length USD of a viewable image size of the panel is greater than or equal to about 520 mm. The panel satisfies the following relationship:

$$0.41 \leq \frac{\text{OAH}}{\text{TOR}} \leq 0.74$$

where TOR is distance between an end of the deflection yoke adjacent to the panel and a coupling surface between the panel and the funnel, and where OAH is distance between center of the outer surface of the panel and the coupling surface between the panel and the funnel.

In another aspect of the present invention, a color cathode ray tube includes: a panel whose outer surface is substantially flat and whose inner surface has a predetermined curvature; a funnel coupled with the panel; and a deflection yoke installed on an outer circumference of the panel, wherein the panel has an aspect ratio of about 16:9; and $$0.47 \leq \frac{\text{OAH}}{\text{TOR}} \leq 0.57$$

where TOR is distance between an end of the deflection yoke adjacent to the panel and a coupling surface between the panel and the funnel, and OAH is distance between center of the outer surface of the panel and the coupling surface of the panel and the funnel.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principle of the invention.

In the drawings.

DETAILED DESCRIPTION OF THE ILLUSTRATED EMBODIMENTS

Reference will now be made in detail to embodiment of the present invention, example of which are illustrated in the accompanying drawings.

Figure 4:
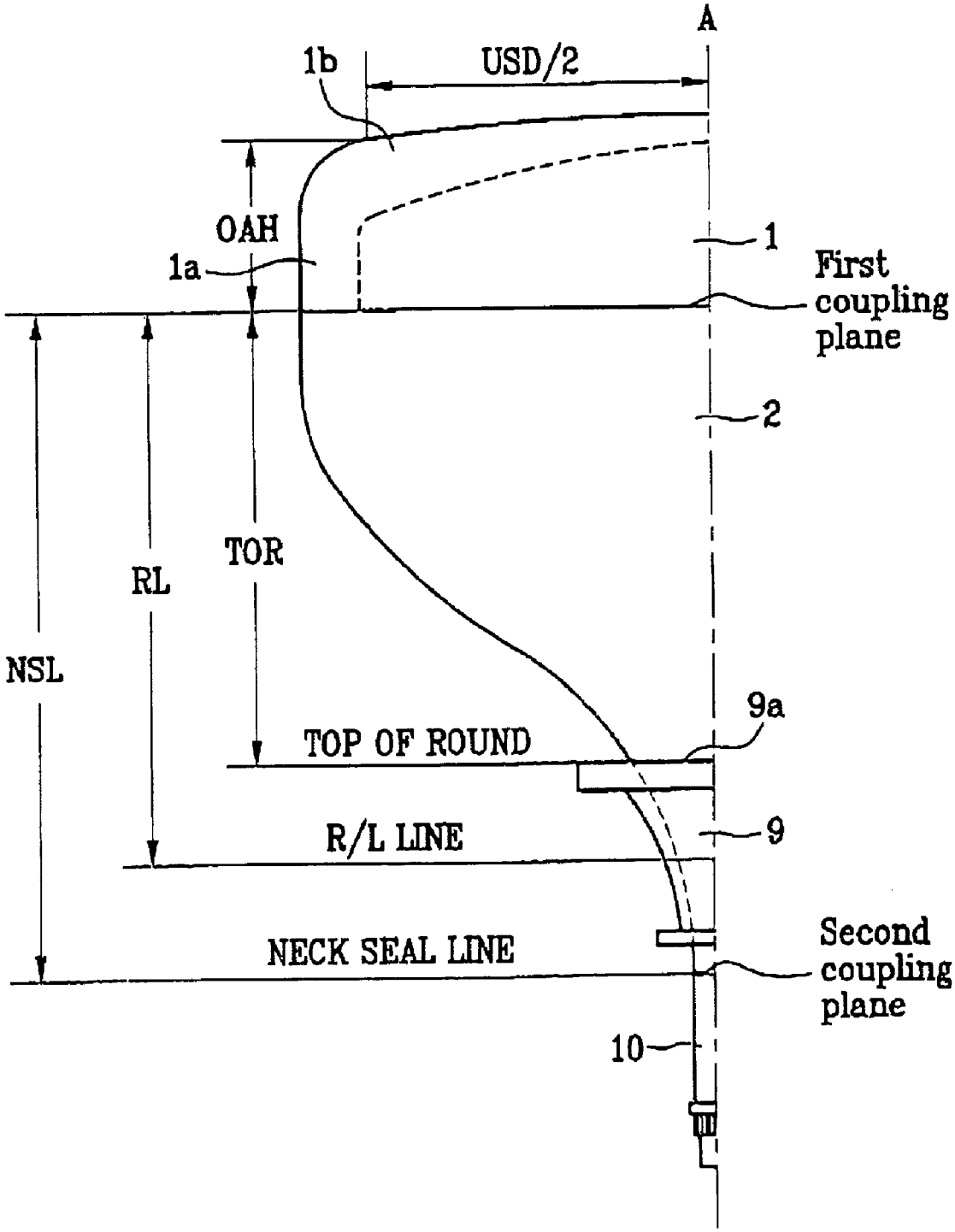
FIG. 4 is a schematic view illustrating the structure of a panel and a funnel of the color CRT according to the present invention.

The CRT according to the present invention may be used in a television set or a monitor, and as shown in FIG. 4 includes a panel 1 and a funnel 2 coupled with a skirt portion 1*a* of the panel 1 by a frit glass. The panel 1 is flat as described above and includes a substantially flat outer surface and an inner surface that has a predetermined curvature. A deflection yoke 9 deflecting an electron beam is installed on the outer circumference of the funnel 2. A neck portion 10 housing the electron gun is manufactured separately and is coupled with the funnel 2 to be one body. Such a CRT includes many reference distances as shown in FIG. 4, and the reference distances will be described below.

First, in the panel 1, OAH is the distance between the seal edge line or end of the skirt 1*a* to the outer surface of the flat panel. Because the end of the skirt 1*a* is coupled with the end of the funnel 2, the distance OAH is the minimum distance from the center of the outer surface to the plane (hereinafter, referred to as 'first coupling plane') that is substantially perpendicular to the center axis A of the CRT and passes through the coupling portion of the panel 1 and the funnel 2. USD is the diagonal length of the viewable image size of the panel 1. Here, the viewable image size is the area forming the real image on the panel 1 and corresponds substantially to the fluorescent surface on the inner surface of the panel 1. The length USD is used in the design of the CRT in the form of USD/2.

In the funnel 2, TOR is the distance from the end 9*a* adjacent to the deflection yoke 9 to a first coupling plane formed between the panel 1 and the funnel 2. Generally, the cross-section of the funnel 2 is almost rectangular between the first coupling plane and the end 9*a*, but circular otherwise to correspond to the cross-section of the deflection yoke 9 that is circular. The first coupling plane includes the panel skirt 1*a* and the end of the funnel 2 as described above. RL is the distance from the deflection center of the deflection yoke 9 to the first coupling plane. The deflection center exists in the deflection yoke 9 where the electron beam begins to be deflected from the deflection center. Finally, NSL is perpendicular to the center axis A and is the distance from the plane (hereafter, second coupling plane) that passes through the coupling portion of the funnel 2 and the neck 10 to the first coupling plane between the panel 1 and the funnel 2. As described above, because the end of the neck 10 is coupled with the funnel 2, the second coupling plane includes the end of the neck 10. More precisely, TOR is perpendicular to the axis A and is the minimum distance from the plane that includes the end of the deflection yoke 9 on the panel side to the first coupling plane. RL is perpendicular to the axis A and is the minimum distance from the plane that passes the deflection center of the deflection yoke 9 to the first coupling plane.

Figure 1:
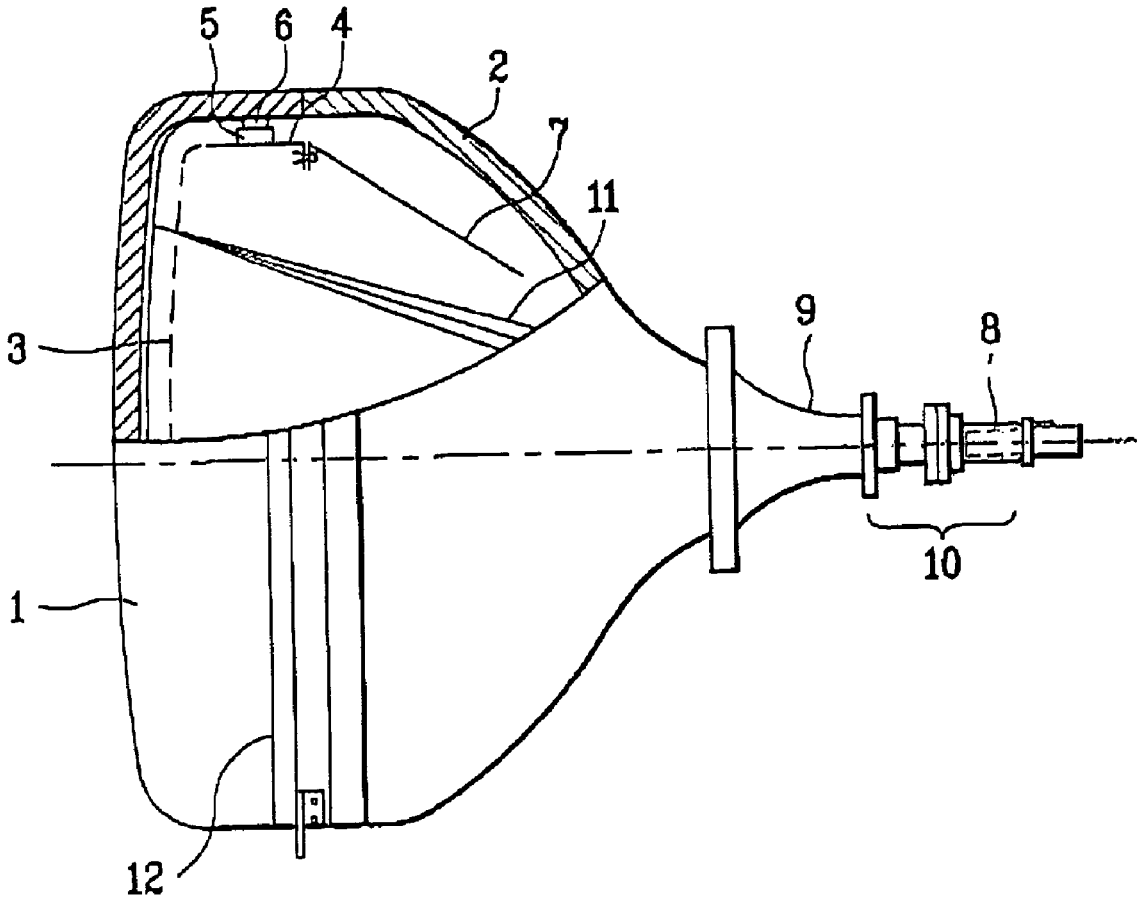
FIG.1 Related Art
FIG. 1 is a partial side sectional view illustrating a general color CRT.
Figure 2A:
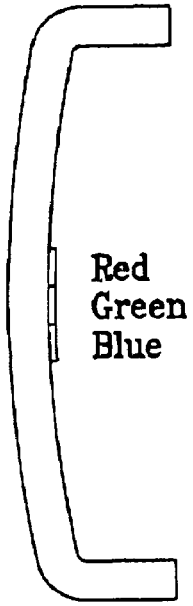
FIG.2A Related Art
FIGS. 2A and 2B are cross-sectional views illustrating a curved panel and a flat panel respectively.
Figure 2B:
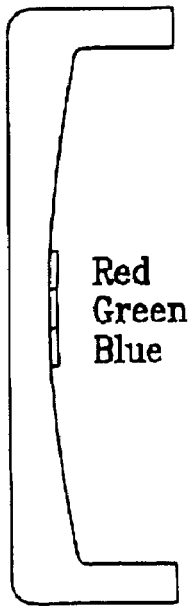
FIG.2B Related Art
Figure 3:
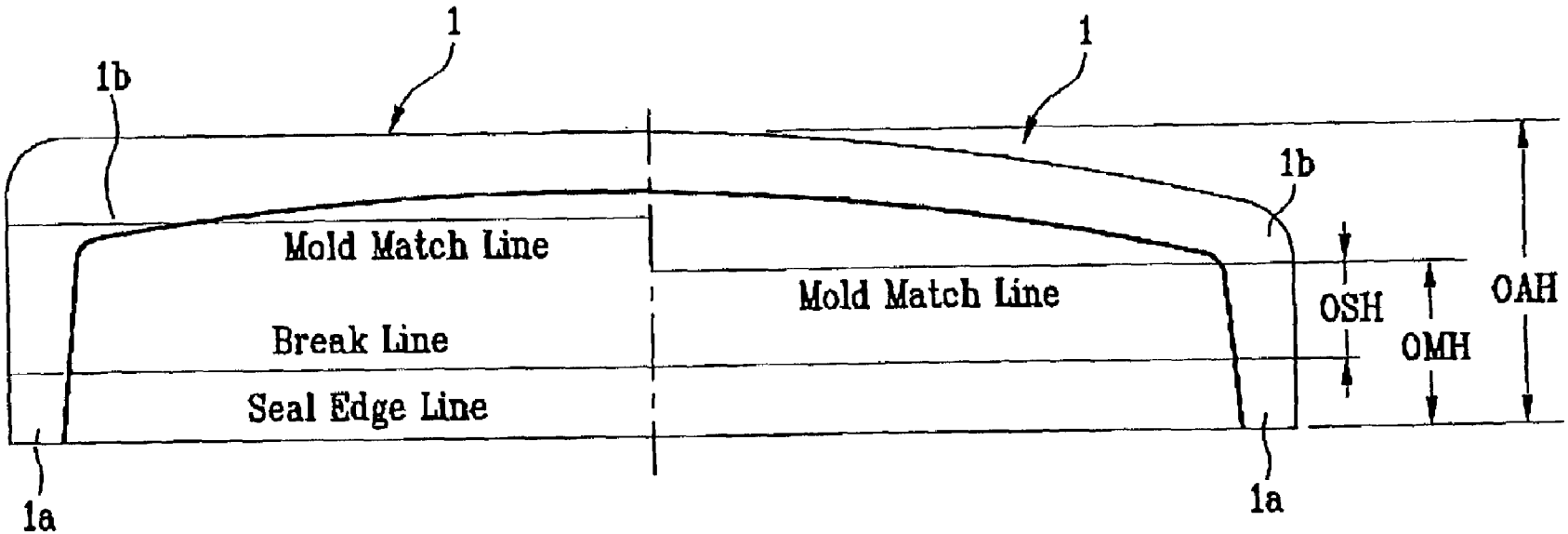
FIG.3 Related Art
FIG. 3 is a cross-sectional view illustrating the difference in the structures of a curved panel and a flat panel shown in FIGS. 2A and 2B respectively.

According to FIG. 3, the flat panel is designed to have the same height OAH as that of the curved panel to share manufacturing processes and equipment as described above. Because the outer surface of the panel is substantially flat as shown in FIG. 3, it is entirely higher than the outer surface of the curved panel. The mold match line passing the boundary of the skirt 1*a* and corner 1*b* of the flat panel is also positioned higher than that of the curved panel. Accordingly, OMH and OSH are comparatively longer for the flat panel, which causes the skirt 1*a* to be lengthened compared to the curved panel. In other words, while the curved panel CRT and the flat panel CRT has the substantially same ratio $$\frac{\text{OAH}}{\text{USD}/2},$$

the ratios $$\frac{\text{OMH}}{\text{USD}/2} \text{ and } \frac{\text{OSH}}{\text{USD}/2}$$

of the flat panel CRT are larger that those of the curved panel CRT. Because the inner surface is curved and the outer surface is flat, the corner 1*b* is very thick. The flat panel CRT is heavier than the curved panel CRT due to the skirt 1*a* and the corner 1*b*.

To solve these problems, the height OAH of the panel of the flat panel CRT may be reduced, and the entire length of the CRT may be reduced compared with the conventional flat panel CRT.

However, the reduced height OAH reduces the weight of the panel and also the distance (hereafter, deflection distance) from the deflection center to the inner surface of the panel 1. If the deflection distance is reduced too much, the design values related to scanning and deflecting an electron beam vary greatly. Accordingly, it is difficult to use the deflection yoke, the electron gun, and the shadow mask used the conventional flat panel CRT without modification. All these components may need to be redesigned. Especially, the deflection angle may need to be increased due to the reduction of the deflection distance. However, the increase of the deflection angle makes the design of the flat panel CRT more difficult and increases the production cost and power consumption. Accordingly, it is desired that the flat panel CRT has a predetermined deflection distance/deflection angle to avoid redesigning other components due to the reduction of the height of the panel 1 OAH. To accomplish this, the length of the panel 2 may be increased to reduce the height of the panel 1. More particularly, any one of the distances TOR, RL and NSL may be increased to increase the length of the funnel 2.

The design considerations in which both the size reduction of the panel 1 and the size change of the CRT, particularly of the funnel 2, are illustrated below by embodiments of the present invention. More particularly, these design considerations are represented using relationships between reference distances of the panel 1 and the funnel 2, and values are calculated for these expressions in each embodiment.

A flat panel CRT according to the first embodiment of the present invention has a panel 1 whose aspect ratio is about 4:3. More particularly, the aspect ratio 4:3 implies $$\frac{M+N}{\sqrt{M^2+N^2}} \geq 1.38$$

where M and N are the lengths of two lines that meet each other perpendicularly in the viewable image size of the panel 1. Additionally, the panel 1 has a diagonal length USD of the viewable image size shorter than 534 mm.

For this flat panel CRT of the first embodiment, the distances OAH and the diagonal length USD of the panel 1 are used as design variables. Because the panel 1 is symmetric USD/2 may be used in the actual design. The distances TOR and RL of the funnel 2 are used as design variables. Here, because OAH determines the length of the skirt 1*a* of the panel 1, OAH serves as the principal design variable in reducing the weight of the panel 1 relative to USD/2. Also, because the deflection center is determined according to the specification of the deflection yoke 9, RL related with the deflection center depends on TOR determined according to the size of the deflection yoke 9. Considering these correlations, in the first embodiment, the ratio of OAH to TOR is used as a fundamental design condition for the design of both the panel 1 and the funnel 2. The other design variables are combined and used as additional design conditions for $$\frac{\text{OAH}}{\text{TOR}}.$$

The design conditions applied to the first embodiment are as follows:

$$\frac{\text{OAH}}{\text{TOR}} \quad (1)$$

$$\frac{\text{OAH}}{\text{RL}} \quad (2)$$

$$\frac{\text{USD}}{2} \times \text{TOR} \quad (3)$$

$$\frac{\text{USD}}{2} \times \text{RL} \quad (4)$$

As described above, optimum values of the design conditions may be calculated to apply the optimum values to actual design of the flat panel CRT and these are represented in Table 1. These optimal values were found through the numerical and structure analyses and tests through experiments and manufacture.

TABLE 1

| | The present invention |
|---|---|
| $\frac{\text{OAH}}{\text{TOR}}$ | $0.44 \leq \frac{\text{OAH}}{\text{TOR}} \leq 0.56$ |
| $\frac{\text{OAH}}{\text{RL}}$ | $0.27 < \frac{\text{OAH}}{\text{RL}} < 0.39$ |
| $\frac{\text{USD}}{2 \times \text{TOR}}$ | $1.72 < \frac{\text{USD}}{2} \times \text{TOR} \leq 1.91$ |
| $\frac{\text{USD}}{2 \times \text{RL}}$ | $1.16 < \frac{\text{USD}}{2} \times \text{RL} \leq 1.25$ |

As shown in Table 1, the flat panel CRT is designed to satisfy $$0.44 \leq \frac{\text{OAH}}{\text{TOR}} \leq 0.56.$$

If $$\frac{OAH}{TOR}$$

is greater than 0.56, OAH increases comparatively too much with respect to TOR. Accordingly, OAH does not reduce very much (12 mm or less) and accordingly the panel 1 is not reduced much in weight. If $$\frac{OAH}{TOR}$$

is less than 0.44, OAH is reduced comparatively too much. Generally, when $$\frac{OAH}{TOR}$$

is less than 0.44, OAH is reduced by about 30 mm. However, the reduction of the thickness of the panel 1 is limited due to safety considerations. Also the reduction of the distance between the shadow mask 3 and the panel 1 and the size reduction of the frame 4 and mask 3 is limited for precise operation. Accordingly, it is difficult to properly design the frame, 4, the mask 3, and the panel 1 when OAH is reduced.

The flat panel CRT of the first embodiment of the present invention is designed to satisfy $$0.27 < \frac{\mathrm{OAH}}{\mathrm{RL}} < 0.39.$$

If $$\frac{OAH}{RL}$$

is greater than or equal to 0.39, OAH increases comparatively too much with respect to RL. Accordingly OAH does not reduce very much (12 mm or less) and accordingly the panel 1 is not reduced much in weight. If $$\frac{OAH}{RL}$$

is large, the deflection distance may be comparatively large instead of increasing OAH and the deflection angle may increase greatly. Accordingly, the electron gun 8 and the deflection yoke 9 may need to be redesigned, and also the power consumption of the deflection yoke 9 increases. If $$\frac{OAH}{RL}$$

is less than or equal to 0.27, OAH may be comparatively large, but the frame 4 or the mask 3 related with the panel 1 cannot be properly designed in accordance with the reduced panel 1.

The flat panel CRT of the first embodiment of the present invention is designed to satisfy $$1.72 < \frac{USD}{2} \times TOR \leq 1.91.$$

If $$\frac{USD}{2 \times TOR}$$

is greater than 1.91, USD increases comparatively to TOR. Generally, if the length USD increases, in other words, if the viewable image size increases, the thickness and the skirt 1*a* of the panel 1 may be increased by a predetermined amount for the panel 1 to have the proper structural strength. Accordingly, OAH increases, and the weight of the panel 1 is not reduced much. If $$\frac{USD}{2 \times TOR}$$

is less than or equal to 1.72, OAH and USD are reduced for the same reason described above. However, the reduction of the thickness of the panel 1 is limited due to safety considerations. Also the reduction of the distance between the shadow mask 3 and the panel 1 and the size of the frame 4 and the mask 3 is limited for precise operation. Accordingly, it is difficult to properly design the frame 4, the mask 3, and the panel 1 when OAH is reduced.

The flat panel CRT of the present invention is designed to satisfy $$1.16 < \frac{USD}{2} \times RL \leq 1.25.$$

If $$\frac{USD}{2 \times RL}$$

is greater than 1.25, OAH as well as USD increases with respect to RL. Accordingly, OAH does not reduce, and the weight of the panel 1 is not reduced much. If $$\frac{USD}{2 \times RL}$$

is less than or equal to 1.16, OAH may be comparatively large, but the frame 4 or the mask 3 related with the panel 1 cannot be properly designed in accordance with the reduced panel 1. On the other hand, if $$\frac{USD}{2 \times RL}$$

is small, RL can be increased instead of USD, and the deflection angle increases. Accordingly, the electron gun 8 and the deflection yoke 9 may need to be redesigned and also the power consumption of the reflection yoke 9 increases.

Meanwhile, because the size of the panel 1 and the deflection distance/deflection angle are actually more sensitive to the design variables OAH and USD of the panel 1, it is also advantageous to consider the design conditions related only to the panel 1 in reducing the panel size and keeping a predetermined deflection distance. To achieve this, the flat panel CRT may be designed to satisfy $$0.23 \leq \frac{OAH}{USD/2} \leq 0.33.$$

Here, if $$\frac{OAH}{USD/2}$$

is less than 0.23, OAH is reduced too much or USD increases comparatively. Accordingly, if OAH is reduced, it is difficult to properly design the related components with respect to the reduction of OAH. If USD is increased, the scan length of the electron beam and the deflection angle increase, and an electron gun and a deflection yoke may need to be redesigned. If $$\frac{OAH}{USD/2}$$

is greater than 0.33, OAH and the size of the panel 1 increase, and the weight of the panel 1 is not reduced. Therefore, the weight of the panel 1 may be reduced without changing the design of the conventional components when $$0.23 \leq \frac{OAH}{USD/2} \leq 0.33.$$

It may be desirable that $$\frac{OAH \times 1000}{USD/2}$$

is set to be less than or equal to 0.4576×USD+106.52 with the set value of $$\frac{OAH}{USD/2}$$

to reduce the weight of the panel without changing the design of the components.

The second embodiment of the present invention has the design conditions of a flat panel CRT having a panel whose aspect ratio is 4:3 that is same as that of the first embodiment, but the panel 1 has a diagonal length USD of the effective screen longer than or equal to 534 mm.

In this flat panel CRT, the second embodiment uses the same design conditions as those of the first embodiment, and their detailed description will be omitted. The optimum values for these design conditions are calculated through numerical analysis and experiment and are summarized in the following table 2.

TABLE 2

| The present invention | |
|---|---|
| $\frac{OAH}{TOR}$ | $0.41 \leq \frac{OAH}{TOR} \leq 0.74$ |

TABLE 2-continued

| The present invention | |
|---|---|
| $\frac{OAH}{RL}$ | $0.35 < \frac{OAH}{RL} \leq 0.53$ |
| $\frac{USD}{2 \times TOR}$ | $1.94 < \frac{USD}{2} \times TOR \leq 2.21$ |
| $\frac{USD}{2 \times RL}$ | $1.57 < \frac{USD}{2} \times RL \leq 1.79$ |

As shown in Table 2, the flat panel CRT of the present invention is designed to satisfy the relationship of $$0.41 \leq \frac{OAH}{TOR} \leq 0.74.$$

If $$\frac{OAH}{TOR}$$

is greater than 0.74, OAH increases. Accordingly, the weight of the panel 1 is not reduced much. If $$\frac{OAH}{TOR}$$

is less than 0.41, OAH is reduced comparatively too much but it is difficult to properly reduce the frame 4 or the mask 3 as well as the panel 1 in size according to the reduction of OAH. Because it is desirable that the weight of the panel 1 is reduced, the flat panel CRT of the present invention is designed according to $$0.41 \leq \frac{OAH}{TOR} \leq 0.69$$

so that the design of the conventional components (frame and mask) may be changed.

The flat panel CRT of the present invention is designed to satisfy $$0.35 < \frac{OAH}{RL} \leq 0.53.$$

Here, if $$\frac{OAH}{RL}$$

is greater than 0.53, OAH increases comparatively. Accordingly, the weight of the panel 1 is not reduced much. When $$\frac{OAH}{RL}$$

is large, RL may be increased compared to OAH, and accordingly the deflection angle increases. Therefore, the electron gun 8 and the deflection yoke 9 may need to be redesigned, and also the power consumption of the yoke 9 increases. If $$\frac{OAH}{RL}$$

is less than or equal to 0.35, OAH may be reduced, but the frame 4 or the mask 3 related with the panel 1 cannot be properly designed with respect to the reduced panel 1.

The flat panel CRT of the second embodiment of the present invention is designed to satisfy $$1.94 < \frac{USD}{2} \times TOR \leq 2.21.$$

If $$\frac{USD}{2 \times TOR}$$

is greater than 2.21, USD and OAH increase as described in the first embodiment. The weight of the panel 1 is not reduced much. If $$\frac{USD}{2 \times TOR}$$

is less than or equal to 1.94, USD and OAH are reduced for the same reason described above. However, it is difficult to reduce the frame 4 or the mask 3 as well as the panel 1 in size to be proportional to the reduction of OAH.

The flat panel CRT of the second embodiment of the present invention is designed to satisfy $$1.57 < \frac{USD}{2} \times RL \leq 1.79.$$

If $$\frac{USD}{2 \times RL}$$

is greater than 1.79, USD and OAH increase compared to RL. Accordingly, the weight of the panel 1 is not reduced much. If $$\frac{USD}{2 \times RL}$$

is less than or equal to 1.57, USD and OAH may be reduced, but the frame 4 or the mask 3 related with the panel 1 cannot be properly designed with respect to the reduced panel 1. On the other hand, if $$\frac{USD}{2 \times RL}$$

is small, RL may be reduced instead of increasing USD, and accordingly the deflection angle increases. Accordingly, the electron gun 8 and the deflection yoke 9 may need to be redesigned, and also the power consumption of the yoke 9 increases.

Meanwhile, the first embodiment of the present invention is designed to satisfy $$0.23 \leq \frac{OAH}{USD/2} \leq 0.33.$$

The criticality of this condition for this range was described, and the description will be omitted.

The third embodiment of the present invention has the design conditions of a flat panel CRT having a panel 1 whose aspect ratio is about 16:9. The panel whose aspect ratio is about 16:9 is wider than the panel whose aspect ratio is about 4:3. In other words, the aspect ratio 16:9 implies $$\frac{M+N}{\sqrt{M^2+N^2}} < 1.38$$

where M and N are the lengths of two lines that meet each other perpendicularly in the effective screen of the panel 1.

For this flat panel CRT, in the third embodiment, the same design conditions as those of the first and second embodiments, and their detailed description will be omitted. The optimum values for the design conditions are calculated through numerical analysis and experiment and are summarized by the following table 3.

TABLE 3

| | The present invention |
|---|---|
| $\frac{OAH}{TOR}$ | $0.47 \leq \frac{OAH}{TOR} \leq 0.57$ |
| $\frac{OAH}{RL}$ | $0.32 \leq \frac{OAH}{RL} < 0.48$ |
| $\frac{USD}{2 \times TOR}$ | $1.65 < \frac{USD}{2} \times TOR \leq 1.98$ |
| $\frac{USD}{2 \times RL}$ | $1.49 < \frac{USD}{2} \times RL \leq 1.68$ |

As shown in Table 3, the flat panel CRT of the present invention is designed to satisfy $$0.47 \leq \frac{OAH}{TOR} \leq 0.57.$$

If $$\frac{OAH}{TOR}$$

is greater than 0.57, OAH increases. Accordingly, the weight of the panel 1 is not reduced much. If $$\frac{OAH}{TOR}$$

is less than 0.47, OAH is reduced comparatively too much, but it is difficult to properly reduce the frame 4 or the mask 3 as well as the panel 1 in size according to the reduction of OAH.

The flat panel CRT of the present invention is designed to satisfy $$0.32 < \frac{OAH}{RL} < 0.48.$$

Here, if $$\frac{OAH}{RL}$$

is greater than or equal to 0.48, OAH increases comparatively. Accordingly, the weight of the panel 1 is not reduced much. RL may be increased comparatived to OAH, and accordingly the deflection angle increases. Therefore, the electron gun 8 and the deflection yoke 9 may need to be redesigned, and also the power consumption of the yoke increases. If $$\frac{OAH}{RL}$$

is less than or equal to 0.32, OAH may be reduced, but the frame 4 or the mask 3 related with the panel 1 cannot be properly designed with respect to the reduced panel 1.

The flat panel CRT of the present invention is designed to satisfy $$1.65 < \frac{USD}{2} \times TOR \leq 1.98.$$

If $$\frac{USD}{2 \times TOR}$$

is greater than 1.98, USD and OAH increase as described in the first embodiment and the second embodiment. The weight of the panel 1 is not reduced much. If $$\frac{USD}{2 \times TOR}$$

is less than or equal to 1.65, USD and OAH are reduced for the same reason described above. However, it is difficult to reduce the frame 4 or the mask 3 as well as the panel 1 in size to be proportional to the reduction of OAH.

The flat panel CRT of the third embodiment of the present invention is designed to satisfy the relationship $$1.49 < \frac{USD}{2} \times RL \leq 1.68.$$

If $$\frac{USD}{2 \times RL}$$

is greater than 1.68, USD and OAH increase as described above. Accordingly, the weight of the panel 1 is not reduced much. If $$\frac{USD}{2 \times RL}$$

is less than or equal to 1.49, OAH may be reduced, but the frame 4 or the mask 3 related with the panel 1 cannot be properly designed with respect to the reduced panel 1. On the other hand, if the length USD is fixed, the deflection angle increases due to the increase of RL. Accordingly, the electron gun 8 and the deflection yoke 9 may need to be redesigned and also the power consumption of the deflection when yoke 9 increases.

As described above, the suggested design conditions may be optimized and the design conditions of the panel 1 are limited to a predetermined range so that the height of the panel can be properly reduced. At the same time, the dimensions of the funnel increases properly to keep a predetermined deflection angle/deflection distance. Accordingly, the weight of the panel 1 may be reduced without redesigning the conventional components (that is, the deflection yoke and the electron beam). Of course, the weight of the funnel increases as the funnel 2 increases in size. However, considering that the 737 mm CRT has a funnel weighing about 7.6 Kg and a panel weighing about 23.9 Kg, because the weight increase of the funnel 2 is negligible, design changes in the CRT of the present invention, are minimized and the total weight of the CRT may be less.

As a result, the light weight and volume of the CRT of the present invention improve the productivity of the CRT and reduce the cost. Also, because the lighter weight and smaller volume of the CRT of the present invention reduce thermal stress, the panel is not easily broken in a furnace while the panel is manufactured. On the other hand, because it is not necessary to change the design of the related components, the production cost may additionally be reduced. Because the deflection angle and distance are kept constant, the consumed power is virtually not increased, even with changing the design to make the panel be lighter.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A color cathode ray tube comprising:

a panel whose outer surface is substantially flat and whose inner surface has a predetermined curvature;

a funnel coupled with the panel; and a deflection yoke installed on an outer circumference of the funnel;

wherein the panel has an aspect ratio of about 4:3 and a diagonal length USD of a viewable image size of the panel is less than about 520 mm; and wherein $$0.44 \le \frac{OAH}{TOR} \le 0.56$$

where TOR is distance between an end of the deflection yoke adjacent to the panel and a coupling surface between the panel and the funnel, and where OAH is distance between center of the outer surface of the panel and the coupling surface between the panel and the funnel.

2. The color cathode ray tube of claim 1, wherein $$0.23 \le \frac{OAH}{USD/2} \le 0.33.$$

3. The color cathode ray tube of claim 2, wherein the color cathode ray tube is used for a television.

4. The color cathode ray tube of claim 1, wherein $$\frac{OAH \times 1000}{USD/2} \le 0.456 \times USD + 106.52.$$

5. The color cathode ray tube of claim 1, wherein $$0.27 < \frac{OAH}{RL} < 0.39$$

where RL is distance between deflection center of the deflection yoke and a coupling surface between the panel and the funnel.

6. The color cathode ray tube of claim 1, wherein $1.72 < USD/(2 \times TOR) \leqq 1.91$.

7. The color cathode ray tube of claim 1, wherein $1.16 < USD/(2*RL) \leqq 1.25$ where RL is distance between deflection center of the deflection yoke and a coupling surface between the panel and the funnel.

8. A color cathode ray tube comprising:

a panel whose outer surface is substantially flat and whose inner surface has a predetermined curvature;

a funnel coupled with the panel; and a deflection yoke installed on an outer circumference of the funnel;

wherein the panel has an aspect ratio of about 4:3 and a diagonal length USD of a viewable image size of the panel is greater than or equal to about 520 mm; and wherein $$0.41 \le \frac{OAH}{TOR} \le 0.74$$

where TOR is distance between an end of the deflection yoke adjacent to the panel and a coupling surface between the panel and the funnel, and where OAH is distance between center of the outer surface of the panel and the coupling surface between the panel and the funnel.

9. The color cathode ray tube of claim 8, wherein $$0.41 \le \frac{OAH}{TOR} \le 0.69.$$

10. The color cathode ray tube of claim 8, wherein $$0.23 \le \frac{OAH}{USD/2} \le 0.33.$$

11. The color cathode ray tube of claim 10, wherein the color cathode ray tube is used for a television.

12. The color cathode ray tube of claim 8, wherein $$0.35 < \frac{OAH}{RL} \le 0.53$$

where RL is distance between deflection center of the deflection yoke and a coupling surface between the panel and the funnel.

13. The color cathode ray tube of claim 8, wherein $1.94 < USD/(2 \times TOR) \leqq 2.21$.

14. The color cathode ray tube of claim 8, wherein $1.57 < USD/(2*RL) \leqq 1.79$ where RL is distance between deflection center of the deflection yoke and a coupling surface between the panel and the funnel.

15. A color cathode ray tube comprising:

a panel whose outer surface is substantially flat and whose inner surface has a predetermined curvature;

a funnel coupled with the panel; and a deflection yoke installed on an outer circumference of the funnel;

wherein the panel has an aspect ratio of about 16:9; and wherein $$0.47 \leq \frac{OAH}{TOR} \leq 0.57$$

where TOR is distance between an end of the deflection yoke adjacent to the panel and a coupling surface between the panel and the funnel, and where OAH is distance between center of the outer surface of the panel and the coupling surface between the panel and the funnel.

16. The color cathode ray tube of claim 15, wherein $$0.32 < \frac{OAH}{RL} < 0.48$$

where RL is distance between deflection center of the deflection yoke and a coupling surface between the panel and the funnel.

17. The color cathode ray tube of claim 15, wherein $1.65 < USD/(2 \times TOR) \leqq 1.98$.

18. The color cathode ray tube of claim 15, wherein $1.49 < USD/(2*RL) \leqq 1.68$ where RL is distance between deflection center of the deflection yoke and a coupling surface between the panel and the funnel.

* * * * *